United States Patent [19]

Bercy

[11] Patent Number: 4,732,367

[45] Date of Patent: Mar. 22, 1988

[54] INSTALLATION FOR THE CONTINUOUS HEAT TREATMENT OF WIRE ROD

[75] Inventor: Paul Bercy, La Louviere, Belgium

[73] Assignee: Usines Gustave Boel Societe Anonyme, La Louviere, Belgium

[21] Appl. No.: 5,804

[22] Filed: Jan. 21, 1987

[30] Foreign Application Priority Data

Jan. 21, 1986 [BE] Belgium ..... 6/48182

[51] Int. Cl.[4] ..... C21D 1/62

[52] U.S. Cl. ..... 266/102; 266/106; 266/133

[58] Field of Search ..... 134/64 R, 122 R; 266/102, 111–113, 130–133, 90

[56] References Cited

U.S. PATENT DOCUMENTS

| | | | |
|---|---|---|---|
| 4,029,524 | 6/1977 | Takahashi et al. | 148/13.1 |
| 4,395,022 | 7/1983 | Paulus et al. | 266/106 |
| 4,397,449 | 8/1983 | Kaneda et al. | 266/106 |
| 4,526,627 | 7/1985 | Wata et al. | 148/12 B |

FOREIGN PATENT DOCUMENTS

| | | | |
|---|---|---|---|
| 1143525 | 7/1986 | Japan | 266/106 |
| 826184 | 7/1983 | South Africa . | |

OTHER PUBLICATIONS

By E. Grattan, G. M. Twigg and P. Benson, "S-ED-C: An Advance in the Controlled Cooling of Carbon Steel Rod", in *Iron and Steel International*, vol. 52 (1979), Oct., No. 4, Guildford, pp. 277–280.

*Primary Examiner*—Christopher W. Brody
*Attorney, Agent, or Firm*—Holman & Stern

[57] ABSTRACT

An apparatus for continuous heat treatment of wire rod comprises a tank containing a water bath maintained at a temperature of at least 75° C., at least one inlet conveyor having an emergent part and a immersed part which is immersed in the water bath, and at least one outfit conveyor having an immersed part immersed in the water bath and an emergent part, the inlet conveyor having a plurality of steps inside the tank which are lower than the maximum upper level of the water bath, and at least one of the steps of the inlet conveyor having a downward inclination not exceeding 3° to horizontal in the direction of conveyor movement, successive steps of the inlet conveyor being interconnected by at least one conveyor section inclined downwardly in the direction of conveyor movement at an angle not exceeding 10° to horizontal. The level of the water bath is varied so that one or more of the steps of the inlet conveyor can be immersed selectively and optionally.

17 Claims, 1 Drawing Figure

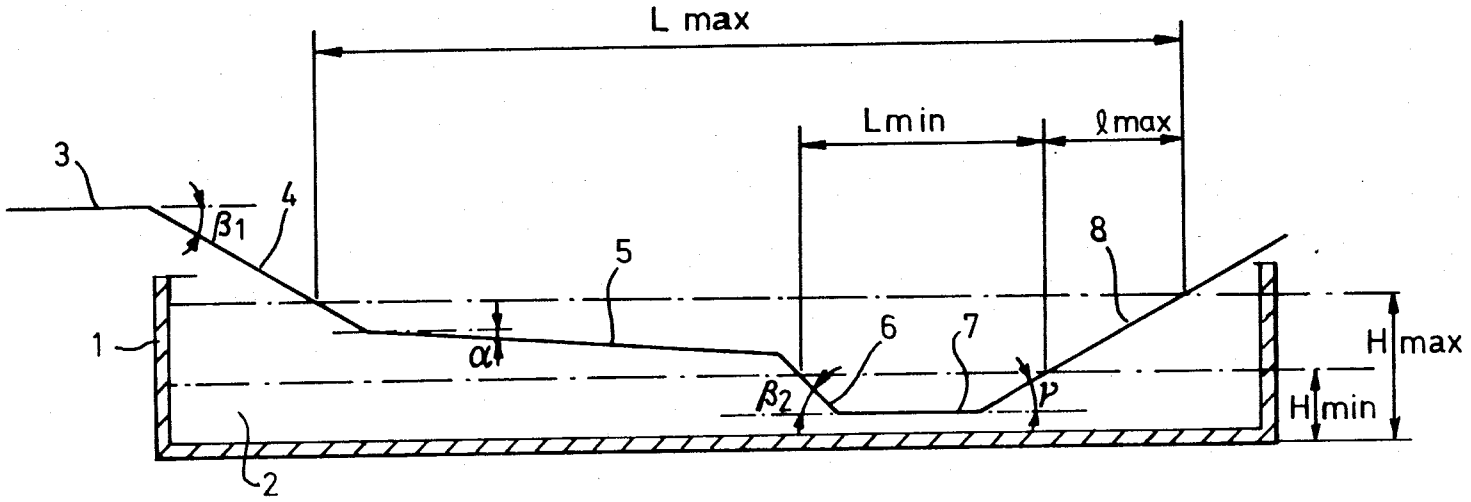
H max
H min
ℓ max
L min
L max
8
7
6
5
4
3
2
1
β
β2
α
β1

INSTALLATION FOR THE CONTINUOUS HEAT TREATMENT OF WIRE ROD

BACKGROUND OF THE INVENTION

1. Field of the Invention

This invention relates to an installation for the continuous heat treatment of wire rod.

2. Description of the Prior Art

Wire rod is, of course, a hot-rolled steel semi-product with numerous possibilities of use. The mechanical properties required of wire rod differ according to the intended area of application. In this respect, wire rod is divided up into hard wire and soft wire. This distinction is based both on the steel carbon content and its breaking strength. Soft wire frequently has a carbon content below 0.4%, and preferably below 0.15%, and the lowest possible breaking strength, e.g. less than approximately 400 MPa, while hard wire contains at least 0.4% of carbon and the highest possible breaking strength. The breaking strength of wire rod depends largely on the cooling applied to the wire.

Various cooling treatments for wire rod known today comprise immersing it in a water bath at a temperature of at least 75° C., these treatments being applied immediately after the hot-rolling mill and being intended for either soft wire or hard wire. In these processes, the wire rod is usually disposed in non-contiguous turns spread out on a conveyor. In a cross-section of the conveyor the temperature distribution in the layer of turns is not uniform. Because of the difference in the metallic mass between the center and the sides, the center of the layer is automatically less hot than the sides, which comprise wire in the form of coils as it were.

It is advantageous to recall the above known points, because they have an effect on the conduct of the wire rod treatment processes.

For example, in order to obtain required strength properties, it is known that the hard wire must undergo at least 90% of its allotropic transformation $\gamma \rightarrow \alpha$ while being immersed in the hot water bath. That means that it must enter the bath with its least hot part (the center) at 720° C. at least and leave this bath with its hottest part (sides) at above 500° C.

On the other hand, the soft wire must undergo at least 80%, and preferably at least 95%, of its allotropic transformation $\gamma \rightarrow \alpha$ before entering the hot water bath. When the wire enters the water bath, its hottest part (the sides) must therefore be at a temperature such that the allotropic transformation is substantially completed throughout the wire. Also, when the wire leaves the water bath, the temperature of its coldest part (the center) will preferably be at least 520° C.; this temperature must be sufficient to comply with a temperature of at least 475° C. to re-form the coils. In the latter case, cooling in a hot water bath does not involve any metallurgical effect; it basically allows the cooling time to be reduced.

The use of these different treatments makes it necessary to use appropriate installations for soft wire and hard wire either in the form of separate installations or in the form of a single convertible installation.

This invention relates to a processing installation of the convertible type.

Known installations of this type usually comprise a stationary water bath, an outlet conveyor situated downstream of the water bath, and an inlet conveyor situated upstream of the water bath. The inlet conveyor is so dimensioned as to allow the soft wire to cool before it enters the bath. The considerable length of this inlet conveyor makes it difficult in the case of hard wire, to maintain an adequate temperature until the wire enters the bath.

The space occupied by the installation, however, must take into account the greatest length required of the inlet conveyor.

BRIEF SUMMARY OF THE INVENTION

The object of this invention is to propose a compact installation which can be used, without appreciable conversion, for the continuous heat treatment of both the soft wire and the hard wire.

To this end, the installation for the continuous heat treatment of wire rod according to this invention is characterized essentially in that it comprises a tank containing a water bath kept at a temperature equal to or greater than 75° C.; at least one inlet conveyor having an emergent part and a part which is immersed in the water bath, and at least one outlet conveyor having a part which is immersed in the water bath and an emergent part, in that the inlet conveyor is stepped so as to have a number of steps inside the said tank and in that the tank is equipped with means enabling the level of the water bath in the tank to be varied so as to immerse one or more steps of said inlet conveyor optionally.

According to one specific embodiment of the invention, at least one of the steps of the inlet conveyor has a downward inclination $\alpha$, in the direction of movement of the wire rod, which may be as much as 3° to the horizontal.

Again according to the invention the successive steps of said inlet conveyor are interconnected by conveyor sections which are inclined downwardly in the direction of movement of the wire rod by an angle $\beta$ which may be as much as 10° to the horizontal.

Again according to the invention, the maximum length of the sum of the immersed parts of the inlet conveyor and of the outlet conveyor is determined according to the maximum cooling time applied to the hard wire in the water bath.

Again according to the invention, the minimum length of the sum of the immersed parts of the inlet conveyor and of the outlet conveyor is determined according to the minimum cooling time applied to the soft wire in the water bath.

According to another feature of the invention, the outlet conveyor has an upward inclination $\gamma$, in the direction of movement of the wire rod, of at least 3° to the horizontal.

According to the invention, the maximum length of the emergent part of the outlet conveyor is so determined that the soft wire leaving this conveyor is substantially at its coil re-formation temperature.

Of course the determination of the various conveyor lengths mentioned in the preceding paragraphs will be carried out allowing, inter alia, for the speed of movement of the wire rod on the conveyor in question.

BRIEF DESCRIPTION OF THE DRAWING

The invention will now be described in detail with reference to one exemplified embodiment illustrated in the accompanying drawing which is a diagrammatic cross-sectional view of a water bath schematically showing the longitudinal profile of a conveyor installation according to the invention for the continuous heat treatment of hard and soft wire.

DETAILED DESCRIPTION

Referring to the drawing, reference number 1 denotes a tank containing a water bath 2 which is kept substantially at boiling temperature. In this case there is disposed, firstly, a stepped inlet conveyor illustrated diagrammatically by the steps 3,5,7 and the inclined sections 4,6, and, secondly, an outlet conveyor 8. The top step 3 and the bottom step 7 are horizontal, while the intermediate step 5 is inclined to the horizontal by an angle $\alpha$ of, for example, 1° 20'. The sections 4 and 6 are respectively inclined by an angle $\beta_1$ and $\beta_2$ which are, for example, respectively 7° and 5°, while the conveyor 8 is inclined by an angle $\gamma$ of, for example, 5°. The level of the water bath in the tank is adjustable by means not shown, between a minimum level $H_{min}$ and a maximum level $H_{max}$. These two extreme levels respectively determine the minimum length $L_{min}$ and the maximum length $L_{max}$ of the horizontal projection of the sum of the immersed parts of the inlet and outlet and also the maximum length $L_{max}$ of the horizontal projection of the emergent part of the outlet conveyor.

In this installation, the wire rod is deposited in turns which are spread out by means of a device known per se (not shown) on the top step 3 of the inlet conveyor. It successively travels through the inclined section 4, the intermediate step 5, the inclined section 6, the bottom step 7 and then the outlet conveyor 8 at the end of which it is re-fromed into coils by a suitable device (not shown). When soft wire is to be treated, the level is adjusted to near its minimum value so as to leave emergent a conveyor length comprising the sections 3,4,5 and a part of the length of section 6 sufficient to provide at least 80° of the allotropic transformation of the wire. The temperature at every point of the wire rod must therefore be less than 770° C. at its entry into the water bath.

By way of example, an extra-mild steel wire 5.5 mm in diameter is deposited on conveyor 3 at a temperature of 890° C. For its temperature to be at the maximum of 770° C. when it enters the bath the wire must be cooled by at least 120° C. at the sides. With a cooling device producing a temperature drop rate of 0.7° C./s the minimum cooling time required is 170 s. The cooling speed can be varied in a manner known per se by means of insulating covers disposed above the conveyor. If an emergent conveyor speed of 0.12 m/s is taken into consideration, the emergent conveyor length will be 20 m. The wire can then be cooled at 600° C. in the water bath set to its minimum level. With conventional immersed conveyor speed conditions (0.32 m/s) and a cooling rate of about 20° C./s the residence time of the wire in the bath is about 9 s and the immersed conveyor length is substantially equal to 3 m. The emergent part of the outlet conveyor then provides cooling to the coil re-formation temperature 475° C.; with a speed of 0.7 m/s and a temperature drop rate of 5° C./s, this emergent part should have a length of 17.5 m.

To treat hard wire on the other hand, the water bath level is raised to close to its maximum value. The water bath then covers the bottom step 7, the inclined section 6, the intermediate step 5 and a portion of inclined section 4 of the inlet conveyor and a large portion of the outlet conveyor 8.

By way of example, a hard wire 5.5 mm in diameter is deposited at a temperature of 880° C. on the top step 3 where it moves at a speed of 0.9 m/s. The water bath is set to a level close to its maximum level so that only the top step 3 and the top part of the inclined section 4 are emergent. Cooling of the hard wire on the emergent part of the inlet conveyor can be slowed down in a manner known per se by means of insulating covers disposed above the conveyor. In this example, the emergent part of the inlet conveyor is 12.5 m in length and the wire rod travels through it in about 14 s. The temperature of the wire at the conveyor center is 725° C. at its entry into the bath set close to its maximum level. Corresponding to this central temperature of 725° C. is a temperature of 770° C. at the sides, and the cooling in the water bath reduces this temperature of the sides to 500° C. maximum. Given a conveyor speed of 0.9 m/s and a wire cooling rate in the water bath of 16° C./s the length $L_{max}$ must be approximately 15 m.

The stepped inlet conveyor installation according to the invention enables the length of the inlet conveyor to be greatly reduced. In the above example, this length is reduced to 12.5 m, equivalent to a reduction of 2.5 m as compared with the conventional lengths of about 15 m. This results in a considerable reduction in the space required and a shortened path for the hard wire before it enters the water bath. From the metallurgical aspect this length reduction increases the possibilities of adjusting the temperature at which the hard wire is deposited and cooled on the conveyor and thus allows the formation of calamine (scale) to be controlled.

The changeover from one level to another is easily effected by any means known per se, particularly "on/-off" valves which provide a fast hot water supply and discharge.

The installation according to this invention enables soft or hard wire to be treated as necessary, as a result of the specific path of the inlet conveyor.

Of course the invention is not limited to the above described exemplified embodiment, but covers any varient coming within the scope of the following claims.

I claim:

1. An apparatus for the continuous heat treatment of wire rod including a tank containing a water bath maintained at a temperature of at least 75° C. and means for varying the level of the water bath in said tank between a maximum upper level and a lower level comprising:

at least one inlet conveyor for conveying wire rod into the water bath having an emergent part above said water bath and a part which is immersed in said water bath;

a plurality of steps on said inlet conveyor so that said inlet conveyor is stepped at least inside said tank and the steps inside said tank are lower than the maximum upper level of said water bath; and at least one outlet conveyor for conveying wire rod out of the water bath having a part which is immersed in said water bath and an emergent part above said water bath.

2. The apparatus as claimed in claim 1 wherein:

said inlet coveyor comprises at least two successive steps interconnected by conveyor sections.

3. The apparatus as claimed in claim 1 wherein:

at least one of said steps of said inlet conveyor has a downward inclination angle $\alpha$ not exceeding 3° relative to horizontal in the conveying direction.

4. The apparatus as claimed in claim 1 wherein:

said inlet conveyor comprises successive steps interconnected by at least one conveyor section inclined downwardly at an angle $\beta$ not exceeding 10° relative to the horizontal in the conveying direction.

5. The apparatus as claimed in claim 1 wherein:
the immersed parts of said inlet conveyor and said outlet conveyor have respective lengths so that the sum thereof does not exceed a value L max equal to the product of the speed of said immersed parts of said inlet conveyor and the maximum cooling time for cooling hard wire rod in the water bath.

6. The apparatus as claimed in claim 1 wherein:
the immersed parts of said inlet conveyor and said outlet conveyor have respective lengths so that the sum thereof is at least a value L min equal to the product of the speed of said immersed parts of said inlet conveyor and the minimum cooling time for cooling soft wire in the water bath.

7. The apparatus as claimed in claim 1 wherein:
said outlet conveyor has an upward inclination angle $\gamma$ in the conveying direction of at least 3° relative to horizontal.

8. The apparatus as claimed in claim 1 wherein:
the length of said emergent part of said outlet conveyor does not exceed a value equal to the product of the outlet conveyor speed and the maximum time required for cooling soft wire rod leaving the water bath to substantially the coil reformation temperature of said soft wire rod.

9. The apparatus as claimed in claim 2 wherein:
said inlet conveyor comprises successive steps interconnected by at least one conveyor section inclined downwardly at an angle $\beta$ not exceeding 10° relative to the horizontal in the conveying direction.

10. The apparatus as claimed in claim 9 wherein:
the immersed parts of said inlet conveyor and said outlet conveyor have respective lengths so that the sum thereof does not exceed a value L max equal to the product of the speed of said immersed parts of said inlet conveyor and the maximum cooling time for cooling hard wire rod in the water bath.

11. The apparatus as claimed in claim 5 wherein:
the immersed parts of said inlet conveyor and said outlet conveyor have respective lengths so that the sum thereof is at least a value L min equal to the product of the speed of said immersed parts of said inlet conveyor and the minimum cooling time for cooling soft wire in the water bath.

12. The apparatus as claimed in claim 1 wherein:
the immersed parts of said inlet conveyor and said outlet conveyor have respective lengths so that the sum thereof is at least a value L min equal to the product of the speed of said immersed parts of said inlet conveyor and the minimum cooling time for cooling soft wire in the water bath.

13. The apparatus as claimed in claim 7 wherein:
said outlet conveyor has an upward inclination angle $\gamma$ in the conveying direction of at least 3° relative to horizontal.

14. The apparatus as claimed in claim 3 wherein:
said outlet conveyor has an upward inclination angle $\gamma$ in the conveying direction of at least 3° relative to horizontal.

15. The apparatus as claimed in claim 12 wherein:
said outlet conveyor has an upward inclination angle $\gamma$ in the conveying direction of at least 3° relative to horizontal.

16. The apparatus as claimed in claim 6 wherein:
the length of said emergent part of said outlet conveyor does not exceed a value equal to the product of the outlet conveyor speed and the maximum time required for cooling soft wire rod leaving the water bath to substantially the coil reformation temperature of said soft wire rod.

17. The apparatus as claimed in claim 15 wherein:
the length of said emergent part of said outlet conveyor does not exceed a value equal to the product of the outlet conveyor speed and the maximum time required for cooling soft wire rod leaving the water bath to substantially the coil reformation temperature of said soft wire rod.

* * * * *